US008240364B2

(12) United States Patent
Schmitz

(10) Patent No.: US 8,240,364 B2
(45) **Date of Patent: *Aug. 14, 2012**

(54) HEAT EXCHANGER TUBE, HEAT EXCHANGER AND USE

(75) Inventor: Friedhelm Schmitz, Dinslaken (DE)

(73) Assignee: Siemens Aktiengesellschaft, München (DE)

( * ) Notice: Subject to any disclaimer, the term of this patent is extended or adjusted under 35 U.S.C. 154(b) by 246 days.

This patent is subject to a terminal disclaimer.

(21) Appl. No.: 12/582,293

(22) Filed: Oct. 20, 2009

(65) Prior Publication Data

US 2010/0037611 A1 Feb. 18, 2010

Related U.S. Application Data

(63) Continuation of application No. 10/588,351, filed as application No. PCT/EP2005/000883 on Jan. 28, 2005, now Pat. No. 7,640,969.

(30) Foreign Application Priority Data

Feb. 3, 2004 (EP) ..... 04002333

(51) Int. Cl.
*F28F 13/18* (2006.01)
*F02C 1/00* (2006.01)

(52) U.S. Cl. ..... 165/133; 165/134.1; 60/730

(58) Field of Classification Search ..... 165/133, 165/134.1, 157, 905; 60/730, 806; 29/890.043; *F28F 19/02*

See application file for complete search history.

(56) References Cited

U.S. PATENT DOCUMENTS

| | | | | |
|---|---|---|---|---|
| 2,064,036 | A | 12/1936 | Sandberg | |
| 3,133,829 | A * | 5/1964 | Cupery et al. | 427/379 |
| 3,265,124 | A | 8/1966 | Reys | |
| 3,357,083 | A * | 12/1967 | Wiehn et al. | 29/890.046 |
| 3,941,087 | A | 3/1976 | Yazaki | |
| 4,564,537 | A | 1/1986 | Austin et al. | |
| 5,014,774 | A | 5/1991 | Siak et al. | |
| 5,083,606 | A | 1/1992 | Brown et al. | |
| 5,152,782 | A | 10/1992 | Kowligi | |
| 5,219,374 | A | 6/1993 | Keyes | |
| 5,558,157 | A | 9/1996 | Makowski et al. | |
| 5,843,214 | A | 12/1998 | Janes | |
| 6,337,129 | B1 | 1/2002 | Watanabe et al. | |
| 2003/0118843 | A1 * | 6/2003 | Reiss et al. | 428/432 |
| 2004/0035561 | A1 | 2/2004 | Ko et al. | |
| 2004/0069466 | A1 * | 4/2004 | Blangetti et al. | 165/133 |

FOREIGN PATENT DOCUMENTS

| | | |
|---|---|---|
| CH | 286 241 | 10/1952 |
| EP | 0 581 820 B1 | 2/1994 |
| FR | 2 414 182 | 8/1979 |
| GB | 22535 | 0/1912 |

(Continued)

*Primary Examiner* — Tho V Duong

(57) ABSTRACT

According to the invention, in order to prevent a film from forming which obstructs the transfer of heat in heat exchanger pipes, the heat exchanger pipe comprises an external side which is adjacent to the external surface and which is impinged upon by a steam medium, and an inner side which is adjacent to an inner surface and which is impinged upon by a coolant, such that the outer surface is provided with a first layer which reduces the adhesion of the steam on the outer surface and/or the inner surface is provided with a second layer which reduces the adhesion of a coolant to the inner surface and which is embodied as a biocidal layer. The invention relates to a heat exchanger and to the use thereof.

12 Claims, 3 Drawing Sheets

FOREIGN PATENT DOCUMENTS

| | | | |
|---|---|---|---|
| GB | 1042386 | | 9/1966 |
| GB | 1042387 | | 9/1966 |
| JP | 61168797 | A | 7/1986 |
| WO | WO 02/40934 | A1 | 5/2002 |

* cited by examiner

HEAT EXCHANGER TUBE, HEAT EXCHANGER AND USE

CROSS REFERENCE TO RELATED APPLICATIONS

This application is a continuation of U.S. Ser. No. 10/588,351 filed on Aug. 3, 2006 now U.S. Pat. No. 7,640,969. This application is the US National Stage of International Application No. PCT/EP2005/000883, filed Jan. 28, 2005 and claims the benefit thereof. The International Application claims the benefits of European Patent application No. 04002333.5 filed Feb. 3, 2004. All of the applications are incorporated by reference herein in their entirety.

FIELD OF THE INVENTION

The invention relates to a heat exchanger tube, with an outside, lying on an outer surface, for action upon it by steam and with an inside, lying on an inner surface, for action upon it by a cooling medium. The invention relates, further, to a heat exchanger with cooling medium routing and with steam medium routing, the cooling medium routing having a multiplicity of heat exchanger tubes for the routing of cooling medium on the inside of a heat exchanger tube, and the steam routing being designed for the action of steam medium upon an outside of a heat exchanger tube. The invention also relates to a use.

BACKGROUND OF THE INVENTION

Heat exchangers of the above type serve, as a rule, for transferring the heat contained in a fluid steam medium to a fluid cooling medium. The steam medium thereby cools, while the cooling medium heats up. If appropriate, the heat exchanger is designed such that the cooling of the steam medium leads to a condensation of the steam medium, in this case a heat exchanger also being designated as a condenser, in particular steam condenser. Heat exchangers, in particular condensers of the type mentioned, are conventionally installed in power plants. There, a fluid steam medium serves, as a rule, as a working medium for driving a turbine and in this case discharges its kinetic energy for driving the turbine to a turbine rotor which, in turn, serves for driving a generator.

Accordingly, a steam medium located on the turbine outlet side is, as a rule, in an expanded state, that is to say it has a pressure in the region of 1 bar and is hardly superheated. This steam medium located on the turbine outlet side is, as a rule, supplied to a heat exchanger, in particular a condenser of the abovementioned type. The aim, as a rule, is to condense the steam medium, if appropriate also further to utilize its heat content after discharge to the cooling medium.

Conventionally, the boundary of a steam medium routing in a heat exchanger of the above type is formed by a walling which is constructed from a multiplicity of heat exchanger tubes of the cooling medium routing. Other concepts provide cooling medium routings arranged transversely in a steam medium routing, so that a steam medium routed in the steam routing has to flow past the multiplicity of heat exchanger tubes of the cooling medium routing. In this case, the closed-in volume of such heat exchangers, in particular of steam condensers, should, depending on the design, be kept as low as possible and be optimized such that the efficiency of such heat exchangers is as high as possible. The aim in a heat exchanger is therefore to configure the heat transfer in a heat exchanger tube as effectively as possible, so that the amount of heat contained in the steam medium can be supplied as fully as possible to the cooling medium and is not otherwise lost or does not remain undesirably in the steam medium. An obstruction of the heat transfer occurs, for example, due to a formation of an insulating condensation film on an outside of a heat exchanger tube. An obstruction of the heat transfer is the more serious, the denser an insulating condensation film of this type is on an outer surface of a heat exchanger tube. In this case, the nature of such a condensation film depends critically on the drop formation or on the dripping behavior of condensed steam medium.

A further impairment of the heat transfer occurs due to the encrustation on the cooling medium side on an inside of a heat exchanger tube. Such encrustation occurs over time, in that inorganic and organic constituents contained in the cooling medium settle and accumulate on the inner surface of a heat exchanger tube. Although various cleaning measures can greatly slow this effect down, they are complicated and cannot prevent the process as such.

A heat exchanger tube and a use relating to the heat exchanger tube, which provide improved heat transfer, would be desirable. It would also be desirable to have a heat exchanger with improved efficiency which is not impaired unnecessarily due to poorer heat transfer in a heat exchanger tube.

SUMMARY OF THE INVENTION

This is where the invention comes in, the object of which being to specify a heat exchanger tube, a heat exchanger and a use relating to a heat exchanger tube, in which heat transfer from a steam medium to a cooling medium is improved, as compared with conventional concepts.

The object is achieved, in terms of a heat exchanger tube, by means of a heat exchanger tube of the type initially mentioned, in which, according to the invention, the outer surface is provided with a first layer reducing an adhesion of the steam medium to the outer surface and/or the inner surface is provided with a second layer reducing an adhesion of the cooling medium to the inner surface, the second layer being configured as a layer reducing the encrustation on the inner surface, and the second layer being configured as a biocidal layer.

The invention arises from the consideration that the surface tension of the tube material is of serious importance for the drop formation or dripping behavior of a steam medium on the outer surface of the heat exchanger tube. Moreover, the invention arises from the consideration that the encrustation on the inner surface of a heat exchanger tube depends to a serious extent on the adhesive properties of the surface. In contrast to measures customary hitherto, which provide either a regular cleaning of the surfaces or additives in the steam/cooling medium, the invention has recognized that it is possible, on the one hand, for the improved configuration of the surface tension of an outer surface and, on the other hand, for the improved configuration of the adhesive properties of an inner surface of a heat exchanger tube, in terms of the requirements explained above, to provide the outer surface with a first layer reducing an adhesion of the steam medium to the outer surface and/or to provide the inner surface with a second layer reducing an adhesion of the cooling medium to the inner surface. As a result, the complicated cleaning measures conventional hitherto on the inside of a heat exchanger tube and measures regarding additives in the cooling medium are reduced. There is the disadvantage that it has not been conventional hitherto to clean on the outside of a heat exchanger tube. Such measures having restrictions have nevertheless been preferred hitherto, since it has not been possible up to now to make heat exchanger tubes of the above type available and, in particular, provide them in a heat exchanger. A principal reason is, inter alia, that, after being manufactured, the tubes can be coated only at a high outlay. Moreover, after the production of the tubes, inner coatings can virtually no longer be carried out, since the tubes possess a length of, as a rule, 10 m or more. In a heat exchanger of the above type for a power station, as a rule, hundreds of kilometers of heat exchanger tubes are laid in place. For a nuclear power station, a heat exchanger may have more than 1000 km of heat exchanger tubes laid in place.

The term "layer" is to be understood in the above sense as meaning not only a coating of the basic surface, that is to say of the outer surface and/or of the inner surface of the heat exchanger tube, but also a surface treatment, having the claimed functionality, of the surface of a heat exchanger tube. For example, the surface of a heat exchanger tube could be smoothed or polished by means of suitable measures. However, coating measures, which are explained further, prove to be substantially more effective according to the above invention.

Advantageous developments may be gathered from the subclaims and specify in detail advantageous possibilities for implementing a heat exchanger tube in terms of its service configuration.

It is expedient to produce a layer as a coating. Particularly advantageously, the first layer and/or the second layer are/is formed from a number of sublayers. In this case, sublayers may serve, for example, as adhesion promoter layers, in order to ensure as good an adhesion as possible of the layer reducing the adhesion of a fluid in the form of steam/cooling medium. Moreover, a series of coating measures in terms of the smoothing or sealing of a surface and/or of the adhesion-reducing layer can be provided.

It has proved particularly expedient that, in the case of a coating of the heat exchanger on both surfaces, that is to say a coating of the outer surface and a coating of the inner surface, the first layer is produced differently from the second layer. For this purpose, advantageously, the first layer is configured as a layer reducing the surface tension of the tube material on the outer surface. Advantageously, in this case, a second layer is configured as a layer reducing the formation of a coating on the inner surface of the tube material, that is to say for reducing the adhesive properties of the inner surface of a heat exchanger tube. Within the framework of the development, it was recognized that the first, steam-side layer, because it is acted upon by steam medium on the outside of the heat exchanger tube, is subject to requirements other than those of the second, cooling-medium side layer which is acted upon by cooling medium on the inside of the heat exchanger tube. The first and the second layer can therefore be optimized differently in terms of their requirements.

Advantageously, therefore, the first layer is configured as a layer reducing the surface tension of the outer surface. This advantageously reduces the drop formation and dripping behavior of the steam medium during a condensation of the latter.

Further, an antifouling layer proves to be advantageous. Such layers reduce the formation of a coating and the growth of a coating of organic substances to a negligible amount. A toxically acting layer may likewise be applied to the inner surface. In particular, such a layer may be configured as a copper layer.

To achieve the object in terms of the heat exchanger, the invention relates to a heat exchanger of the type initially mentioned, in which a heat exchanger tube is designed according to the invention in a way explained above.

It proved most particularly expedient that the heat exchanger tube is designed as a longitudinally welded heat exchanger tube. That is to say, in the heat exchanger tube, a weld seam runs along the elongate extent of the tube and, in the installed state of the tube, is arranged on the top side of the tube cross section.

To be precise, it was shown that a layer, in particular coating, produced according to the proposed concept, of a heat exchanger tube is advantageously applied even on wide or narrow strips from which heat exchanger tubes are normally produced. Wide or narrow strips are strip-shaped metal plates having the wall thickness of a heat exchanger tube, which are subsequently rounded into a slotted tube slotted along a longitudinal seam.

This slotted tube is then provided along the longitudinal seam with a weld seam for producing the heat exchanger tube. Since the layer, in particular coating, provided according to the concept of the invention, may possibly impair the welding process or the quality of the weld seam, the layer may be removed again locally in the region of the weld seam before the welding process. By the layer being removed in the region of the weld seam, the above-explained effect of the layer is impaired only insignificantly, so that, according to the concept of the invention, approximately 90% to 95% of the above-explained desired effects are still achieved.

Advantageously, the layer is removed in the region of the slot/weld seam immediately before the welding process and also in the process of forming the strip into the slotted tube.

Expediently, a coating in the local region of the weld seam is prevented by means of a local masking of the weld seam region during the coating process. Alternatively or additionally, the weld seam region may be ground so that an already existing layer, in particular coating, is removed again within the framework of such a grinding process.

What is achieved by a subsequent installation of a heat exchanger tube, in which the weld seam is arranged along the elongate extent of the tube on the top side of the tube cross section, that is to say in a twelve-o'clock position, is that the weld seam which in such a case is not provided with a layer is subjected to encrustation to a lesser extent than the side lying opposite the weld seam and the remaining regions of a heat exchanger tube. What is therefore achieved by this advantageous measure is that, on the one hand, the welding process, which completes a slotted tube into the heat exchanger tube, is not impaired by a layer according to the proposed concept and, on the other hand, a particularly high fraction of the above-explained desired effects, advantageously in a range above 95 percent, is nevertheless achieved.

The object in terms of a use relating to the heat exchanger tube is achieved, according to the invention, by a use of a layer material reducing an adhesion of a fluid to a surface for an outer surface on an outside of a heat exchanger tube for action upon it by a steam medium and for an inner surface on an inside of the heat exchanger tube for action upon it by a cooling medium.

In particular, the outer surface is provided with a first layer reducing an adhesion of the steam medium to the outer surface and/or the inner surface is provided with a second layer reducing an adhesion of the cooling medium to the inner surface.

It proved particularly advantageous that the layer material used is a material based on polytetrafluoroethylene (PTFE). For this purpose, advantageously, a material which contains PTFE in the form of Teflon may be used.

It was further shown that a material based on a carbon system is advantageous as a layer material. In particular, a material constructed according to a diamond-like system (DLC system) proved to be particularly advantageous.

Further, a material based on an organic silicate network proved to be particularly advantageous for use as a layer material. Such organic silicate networks can advantageously be produced as an outer surface consisting of nanoparticles which decisively reduce the antistick properties of a surface, in particular of an inner surface of the heat exchanger tube.

In a very similar way, a DLC system surface proves to be particularly advantageous on an inner surface of the heat exchanger tube.

A layer material based on a polytetrafluoroethylene may be used particularly advantageously on an outer surface of a heat exchanger tube.

The use of all the layer materials mentioned for a heat exchanger tube according to the concept explained above can be implemented advantageously in a surprising way according to the finding of the invention, since, according to measures conventional hitherto, layers of the abovementioned type could not be implemented at all on heat exchanger tubes and therefore could not be considered by a person skilled in the art.

BRIEF DESCRIPTION OF THE DRAWINGS

Exemplary embodiments of the invention are described below with reference to the drawing. This is not intended to illustrate the exemplary embodiments true to scale, but, instead, the drawing, where appropriate for an explanation, is in diagrammatic and/or slightly distorted form. As regards additions to the teachings which can be seen directly from the drawing, reference is made to the relevant prior art. In particular, in the drawing.

FIG. 1 shows a heat exchanger tube 1 in the installed state in a heat exchanger, such as is shown diagrammatically in FIG. 2. In the installed state, the particularly preferred embodiment, shown here, of the heat exchanger tube 1 provides a layer 7, 9 reducing an adhesion of a fluid to a surface 3, 5 of the heat exchanger tube 1. Certain embodiments contain a plurality of sublayers denoted 7*a*, 7*b*, 9*a*, and 9*b*. The heat exchanger tube 1 has a steam-side outer surface 3 on its outside 4 for action upon it by a steam medium 25 and a cooling-medium side inner surface 5 on its inside 6 for action upon it by a cooling medium 27. The outer surface 3 is provided with a first layer 7 reducing an adhesion of the steam medium to the outer surface 3. The inner surface 5 is provided with a second layer 9 reducing an adhesion of the cooling medium to the inner surface 5.

Figure 1:
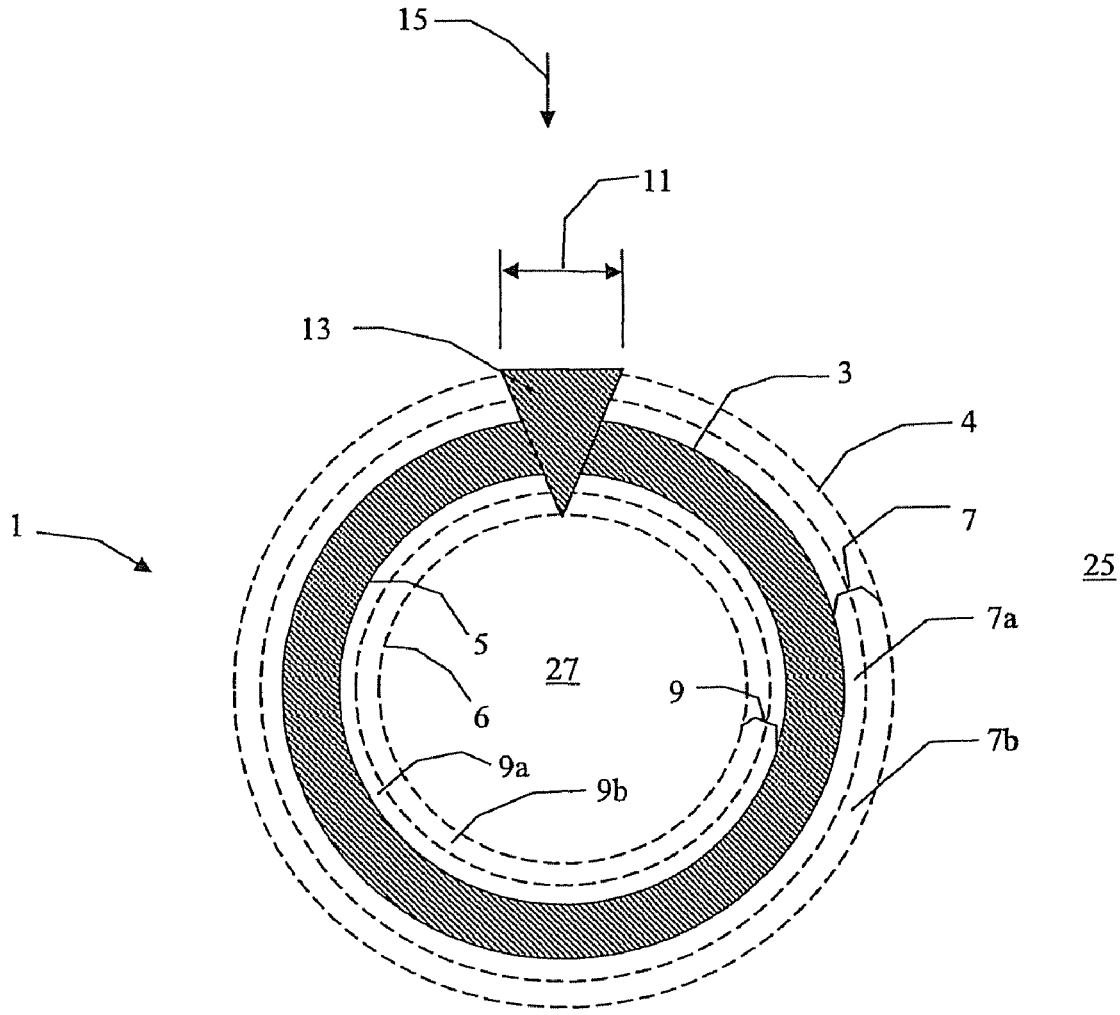
FIG. 1 shows a cross section through a heat exchanger tube in the installed state according to a particularly preferred embodiment.

In the present case, the first, steam-side layer 7 is manufactured from a layer material which is a material based on a PTFE (polytetrafluoroethylene). In the present case, a mixture of Teflon and other components is preferred. The second, cooling-medium side layer 9 is in the present case a material based on an organic silicate network. In the present case, for the formation of nanoparticles, this material was produced according to what is known as a sol/gel process and consequently has a surface structured in the nanometer range. It was shown that this type of coating with a second layer 9 on an inner surface 5 particularly advantageously prevents the sticking properties of a cooling medium and consequently the deposition and accumulation of organic and inorganic material on the inner surface 5 of the heat exchanger tube 1. A first layer 7, based on polytetrafluoroethylene, on an outer surface 3 of the heat exchanger tube 1 has a particularly low surface tension and consequently reduces the drop formation on the surface, and, insofar as drops are formed, the dripping behavior is varied in such a way that no condensation films can form on the outer surface 3 of the heat exchanger tube 1.

The heat exchanger tube 1 shown in this embodiment is advantageously produced from a narrow strip which has already been provided as such, on its face assigned to the inner surface 5, with an organic silicate network of the layer 9 to form an inside 6 and being provided, on a face assigned to the outer surface 3, with a material based on polytetrafluoroethylene to form an outside 4. Within the framework of the further production process, the narrow strip, in the region 11, that is to say at its edges which would later lie in the region 11 of the welded seam 13, was masked as early as during the coating process for forming the layers 9, 7 and, in this embodiment, was subsequently ground down, so that the region 11 of the weld seam 13 remained free of coating. The grinding-down step may even be dispensed with within the framework of a modification. After the rounding of the narrow strip into the slotted tube in the further production step, it was possible for the weld seam 13 to be applied to the slotted tube in order to complete the heat exchanger tube, without adverse effects of a coating 9, 7 on the welding process having to be taken into account in this case.

In the installed state, the heat exchanger tube 1 is installed in a heat exchanger 17 in the twelve-o'clock position shown in FIG. 1, that is to say the weld seam 13 is located on the top side 15 of the tube cross section.

Figure 3:
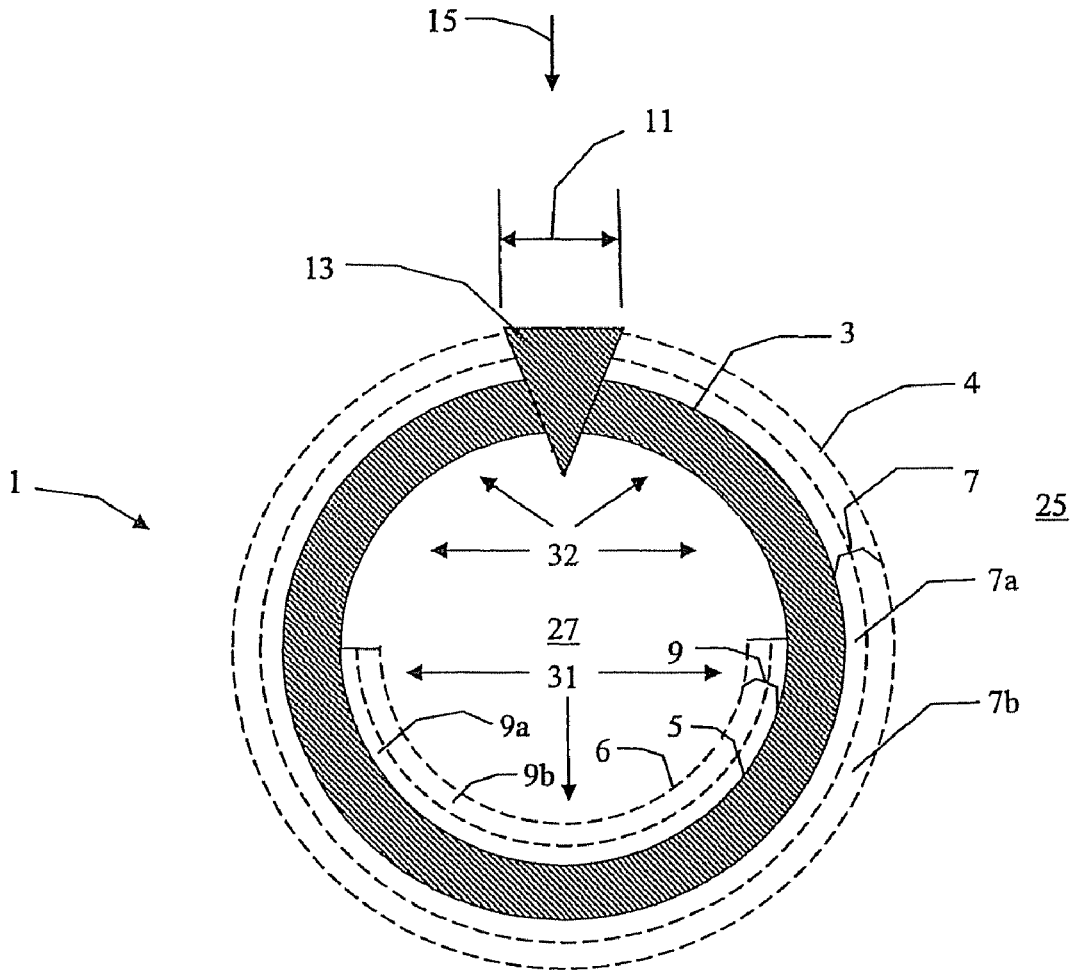
FIG. 3 shows the same cross section of the tube shown in FIG. 1 in the installed state according to another preferred embodiment.

Within the framework of a modification, a heat exchanger tube may be coated, essentially by means of the same production method explained above, solely in the region 31 of its three-o'clock position up to the nine-o'clock position, as shown in FIG. 3, leaving region 32 uncoated. To be precise, it was shown that, in particular, the region around the six-o'clock position is particularly susceptible to corrosion and to encrustation in a heat exchanger tube. In particular, suspended substances often, for example, above all, during an emptying of the heat exchanger tube, remain in the region of the six-o'clock position on the inside of the heat exchanger tube. At least the region around the six-o'clock position, for example a 45°-angle region, a 90-angle region, advantageously a 120° angle region and, in particular, a 180-angle region or an in each case greater angle region, is provided with a layer within the framework of the modification.

Figure 2:
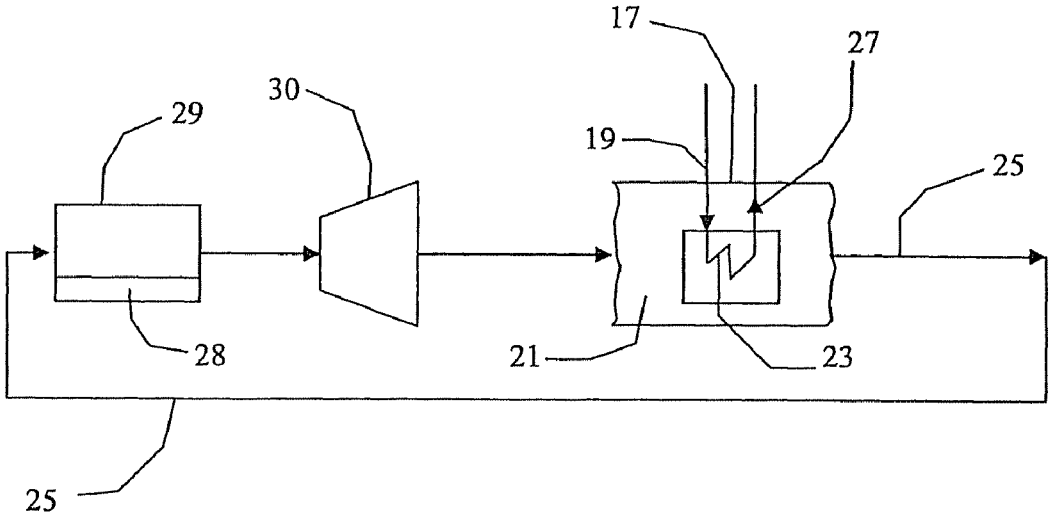
FIG. 2 shows a diagrammatical illustration of a heat source, a boiler connected to the heat source to generate the steam medium, a turbine for expanding the steam flow, and a heat exchanger according to a particularly preferred embodiment with cooling medium routing and steam medium routing.

FIG. 2 shows diagrammatically a heat source 28, a boiler 29 connected to the heat source to generate the steam medium 25, a turbine 30 for expanding the steam flow, and a heat exchanger 17 with cooling medium routing 19 and with steam routing 21. The cooling medium routing 19 has, for routing the cooling medium 27, a multiplicity of heat exchanger tubes 23 which are explained in more detail in FIG. 1 and are shown merely diagrammatically in FIG. 2. The cooling medium 27 is in this case routed on the inside 6 of the heat exchanger tubes 23. The steam routing 21 provides for the action of a steam medium 25 upon the outside 4 of the heat exchanger tubes 23.

In order to avoid film formation obstructing the heat transfer in heat exchanger tubes 1, 23, in a heat exchanger 1, 23 with an outside 4, lying on an outer surface 3, for action upon it by a steam medium and with an inside 6, lying on an inner surface 5, for action upon it by a cooling medium, there is provision, according to the proposed concept, for the outer surface 3 to be provided with a first layer 7 reducing an adhesion of the steam to the outer surface 3 and/or for the inner surface to be provided with a second layer 9 reducing an adhesion of the cooling medium to the inner surface 5. The concept leads to a heat exchanger 17 and a use.

The invention claimed is:

1. A power plant heat exchanger, comprising:

a plurality of heat exchanger tubes that route a cooling medium, having an outside surface and an inside surface, the inside surface comprising an uppermost portion that encompasses an uppermost position of the tube when the tube is oriented for operation, and a non-uppermost portion location remote from the uppermost portion, wherein:

a first layer is arranged on the outside surface of the tube for reducing an adhesion of the steam medium, and a second toxically acting layer, which includes a second material that is different than the first material of the first layer, limited to covering the non-uppermost portion of the inside surface of the tube, wherein the toxically acting layer reduces formation and growth of organic substances on the non-uppermost portion of the inside surface of the tube through a toxic effect on organic substances; and a steam medium routing configured to rout a steam medium upon the outside surface of the heat exchanger tube.

2. The heat exchanger as claimed in claim 1, wherein the heat exchanger tube is a longitudinally welded tube having a weld seam running along a long axis of the tube and the tube is arranged in the assembled heat exchanger such that the tube weld seam is located at the uppermost position of the tube cross section when the tube is in operation.

3. The heat exchanger as claimed in claim 1, wherein the non-uppermost portion of the inside surface of the tube starts at the tube's three o'clock position and ends at the tube's nine o'clock position.

4. The heat exchanger as claimed in claim 1, wherein the second toxically acting layer comprises an organic silicate network.

5. The heat exchanger as claimed in claim 4, wherein the organic silicate network comprises a surface structured in the nanometer range.

6. The heat exchanger as claimed in claim 1, wherein the second toxically acting layer comprises copper.

7. The heat exchanger as claimed in claim 1, wherein the second toxically acting layer comprises a material constructed according to a diamond-like system (DLC).

8. The heat exchanger as claimed in claim 1, wherein the first layer comprises polytetraflouroethylene.

9. The heat exchanger as claimed in claim 1, wherein the uppermost portion comprises a 45° angle region of a circumference of a cross section of the heat exchanger tubes.

10. The heat exchanger as claimed in claim 1, wherein the uppermost portion comprises a 90° angle region of a circumference of a cross section of the heat exchanger tubes.

11. The heat exchanger as claimed in claim 1, wherein the uppermost portion comprises a 120° angle region of a circumference of a cross section of the heat exchanger tubes.

12. A power plant heat exchanger, comprising:

a plurality of heat exchanger tubes that route a cooling medium, having an outside surface and an inside surface, the inside surface comprising an uppermost portion that encompasses an uppermost position of the tube when the tube is oriented for operation, and a non-uppermost portion location remote from the uppermost portion, wherein:

a first layer is arranged on the outside surface of the tube for reducing an adhesion of the steam medium, and a second toxically acting layer, which includes a second material that is different than the first material of the first layer, arranged on the non-uppermost portion of the of the inside surface of the tube but not arranged on the uppermost portion of the inside surface, wherein the toxically acting layer reduces formation and growth of organic substances on the non-uppermost portion of the inside surface of the tube through a toxic effect on organic substances; and a steam medium routing configured to rout a steam medium upon the outside surface of the heat exchanger tube.

* * * * *